US006659390B2

(12) United States Patent
Black

(10) Patent No.: US 6,659,390 B2
(45) Date of Patent: Dec. 9, 2003

(54) MATERIAL DISPENSING SYSTEM

(75) Inventor: Charles D. Black, Williston, ND (US)

(73) Assignee: New Products Marketing Corporation, Williston, ND (US)

( * ) Notice: Subject to any disclaimer, the term of this patent is extended or adjusted under 35 U.S.C. 154(b) by 0 days.

(21) Appl. No.: 09/996,666

(22) Filed: Nov. 28, 2001

(65) Prior Publication Data

US 2003/0098384 A1 May 29, 2003

(51) Int. Cl.[7] ..... B65H 65/00; B65H 75/28
(52) U.S. Cl. ..... 242/588.2; 242/597.4
(58) Field of Search ..... 242/597.4, 597.6, 242/588.2, 588.1

(56) References Cited

U.S. PATENT DOCUMENTS

| | | | | |
|---|---|---|---|---|
| 1,825,822 A | | 10/1931 | Rundell | |
| 2,171,648 A | | 9/1939 | Ennis et al. | |
| 2,632,605 A | | 3/1953 | Lee | |
| 3,346,208 A | | 10/1967 | Hoffman et al. | |
| 3,347,485 A | | 10/1967 | Bundschuh | |
| 3,612,423 A | | 10/1971 | Bahnsen | |
| 4,235,389 A | | 11/1980 | Ness | |
| 4,714,211 A | * | 12/1987 | Hwang | 242/96 |
| 5,125,586 A | * | 6/1992 | Whitethorn | 242/55.2 |
| 5,328,115 A | | 7/1994 | Samuelson et al. | |
| 5,370,339 A | | 12/1994 | Moody et al. | |
| 5,577,686 A | * | 11/1996 | Moody | 242/597.4 |
| 5,683,058 A | | 11/1997 | Schwarz et al. | |
| 5,775,632 A | * | 7/1998 | Huerta | 242/597.6 |
| 5,842,655 A | * | 12/1998 | McCarthy | 242/129 |
| 6,257,298 B1 | * | 7/2001 | Huang | 156/577 |
| 6,302,177 B1 | * | 10/2001 | Gruber | 156/527 |
| 6,457,669 B1 | * | 10/2002 | Chuang | 242/588.2 |
| 2001/0042810 A1 | * | 11/2001 | Christensen et al. | 242/597.2 |
| 2002/0070308 A1 | * | 6/2002 | Fahringer | 242/423.2 |

FOREIGN PATENT DOCUMENTS

| | | | | |
|---|---|---|---|---|
| EP | 0156468-a1 | * | 10/1985 | B65G/11/02 |
| EP | 0300695-a2 | * | 1/1989 | B65H/16/04 |
| GB | 2065070 A | * | 6/1981 | B65H/75/30 |
| GB | 2209325 A | * | 5/1989 | B65H/23/06 |

* cited by examiner

*Primary Examiner*—Michael R. Mansen
*Assistant Examiner*—Sang Kim
(74) *Attorney, Agent, or Firm*—Michael S. Neustel

(57) ABSTRACT

A material dispensing system for allowing convenient replacement of a spool of elongate material. The material dispensing system includes a tubular main body formed for receiving a spool of material, a handle attached to the tubular main body, and a set of retaining prongs positioned within the main body for selectively retaining the spool of material upon the main body. The retaining prongs are comprised of a resilient material for allowing the distal portions thereof to be forcibly contracted thereby allowing the spool of material to be unloaded and a replacement spool to be loaded. The retaining prongs have a flanged portion that extend outwardly and have a total width greater than an inner diameter of the spool of material.

17 Claims, 10 Drawing Sheets

MATERIAL DISPENSING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to elongate material dispensers and more specifically it relates to a material dispensing system for allowing convenient unloading, loading and dispensing of a spool of elongate material.

2. Description of the Prior Art

Elongate material dispensers have been in use for years. Conventional elongate materially dispensers are formed for receiving and dispensing a spool of material such as barricade tape, flagging tape, string, rope, wire and other elongate materials. The BEN MEADOWS COMPANY manufactures a barricade tape dispenser that is comprised of a complex structure which is difficult to load and unload a spool of material. There are other products on the market that receive and dispense elongate material upon a spool, but they are relatively difficult to load and unload.

Examples of patented devices which are related to the present invention include U.S. Pat. No. 2,171,648 to Ennis et al.; U.S. Pat. No. 1,825,822 to Rundell; U.S. Pat. No. 4,235,389 to Ness; U.S. Pat. No. 5,328,115 to Samuelson et al.; U.S. Pat. No. 2,632,605 to Lee; U.S. Pat. No. 5,370,339 to Moody et al.; U.S. Pat. No. 3,346,208 to Hoffman et al.; U.S. Pat. No. 5,683,058 to Schwarz et al.; U.S. Pat. No. 3,347,485 to Bundschuh; and U.S. Pat. No. 3,612,423 to Bahnsen.

While these devices may be suitable for the particular purpose to which they address, they are not as suitable for allowing convenient replacement of a spool of elongate material. Conventional material dispensing devices are difficult to load and unload with a spool of material.

In these respects, the material dispensing system according to the present invention substantially departs from the conventional concepts and designs of the prior art, and in so doing provides an apparatus primarily developed for the purpose of allowing convenient replacement of a spool of elongate material.

SUMMARY OF THE INVENTION

In view of the foregoing disadvantages inherent in the known types of material dispensers now present in the prior art, the present invention provides a new material dispensing system construction wherein the same can be utilized for allowing convenient replacement of a spool of elongate material.

The general purpose of the present invention, which will be described subsequently in greater detail, is to provide a new material dispensing system that has many of the advantages of the material dispensers mentioned heretofore and many novel features that result in a new material dispensing system which is not anticipated, rendered obvious, suggested, or even implied by any of the prior art material dispensers, either alone or in any combination thereof.

To attain this, the present invention generally comprises a tubular main body formed for receiving a spool of material, a handle attached to the tubular main body, and a set of retaining prongs positioned within the main body for selectively retaining the spool of material upon the main body. The retaining prongs are comprised of a resilient material for allowing the distal portions thereof to be forcibly contracted thereby allowing the spool of material to be unloaded and a replacement spool to be loaded. The retaining prongs have a flanged portion that extend outwardly and have a total width greater than an inner diameter of the spool of material.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a material dispensing system that will overcome the shortcomings of the prior art devices.

A second object is to provide a material dispensing system for allowing efficient replacement of a spool of elongate material.

Another object is to provide a material dispensing system that is easy to load and unload a spool of material.

An additional object is to provide a material dispensing system that may be utilized with spools of material such as but not limited to barricade tape, flagging tape, string, rope, wire and other elongate materials.

A further object is to provide a material dispensing system that is ergonomic thereby reducing stress upon the user's fingers and wrist during usage.

Another object is to provide a material dispensing system that allows a user to easily sever a desired length of the elongate material.

A further object is to provide a material dispensing system that may be removably attached to the user.

Another object is to provide a material dispensing system that may be attached to a wall, floor or similar structure for dispensing the spool of material.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
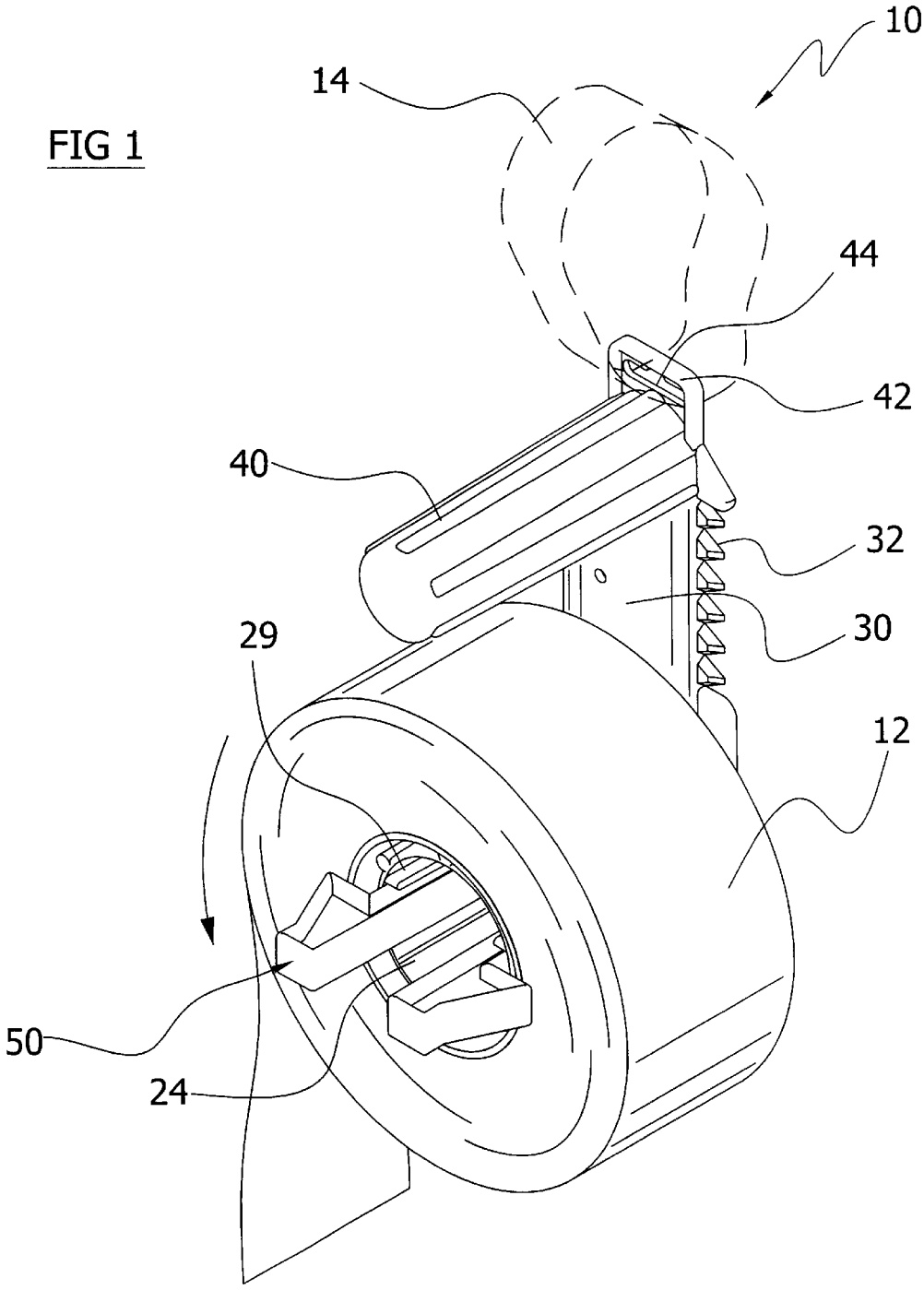
FIG. 1 is an upper perspective view of the present invention with a spool of material positioned upon thereof.

Turning now descriptively to the drawings, in which similar reference characters denote similar elements throughout the several views, FIGS. 1 through 12 illustrate a material dispensing system 10, which comprises a tubular main body 20 formed for receiving a spool of material 12, a handle attached to the tubular main body 20, and a set of retaining prongs 50 positioned within the main body 20 for selectively retaining the spool of material 12 upon the main body 20. The retaining prongs 50 are comprised of a resilient material for allowing the distal portions thereof to be forcibly contracted thereby allowing the spool of material 12 to be unloaded and a replacement spool to be loaded. The retaining prongs 50 have a flanged portion that extend outwardly and have a total width greater than an inner diameter of the spool of material 12.

As shown in FIGS. 2 through 6 of the drawings, the main body 20 is comprised of a tubular structure having a front end and a rear end. The outer surface of the main body 20 has a width less than the inner diameter of the spool of material 12 for allowing free rotation of the spool 12. The front end of the main body 20 is open for allowing the retaining prongs 50 to extend from the interior portion 24 of the main body 20.

The main body 20 is preferably comprised of a tubular structure having a circular cross sectional shape as is illustrated within the drawings, however the main body 20 may have various other cross sectional shapes that are capable of receiving a spool of material 12. Various other structures and configurations may be utilized to construct the main body 20 though not illustrated within the exemplary drawings.

Figure 2:
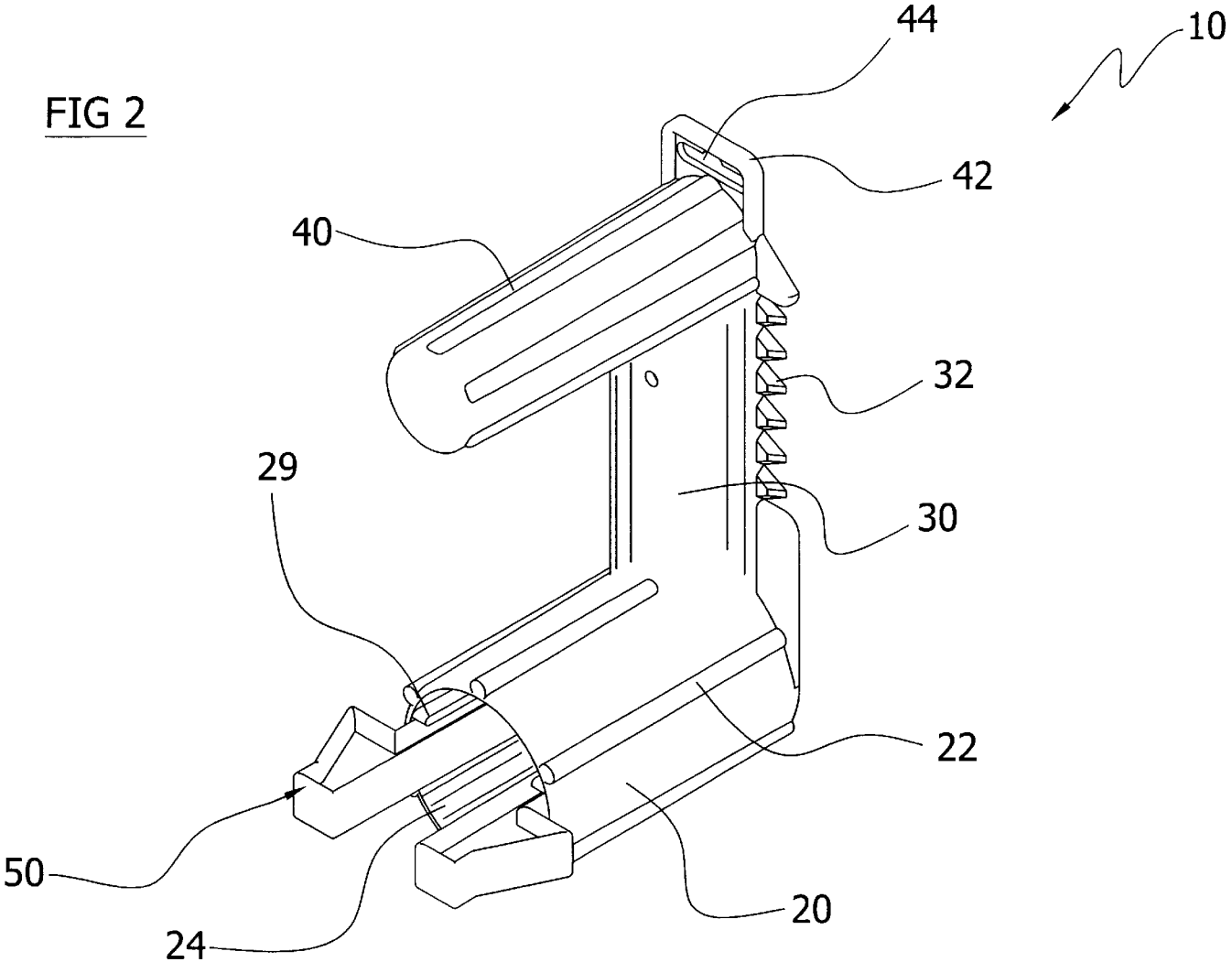
FIG. 2 is an upper perspective view of the present invention.
Figure 3:
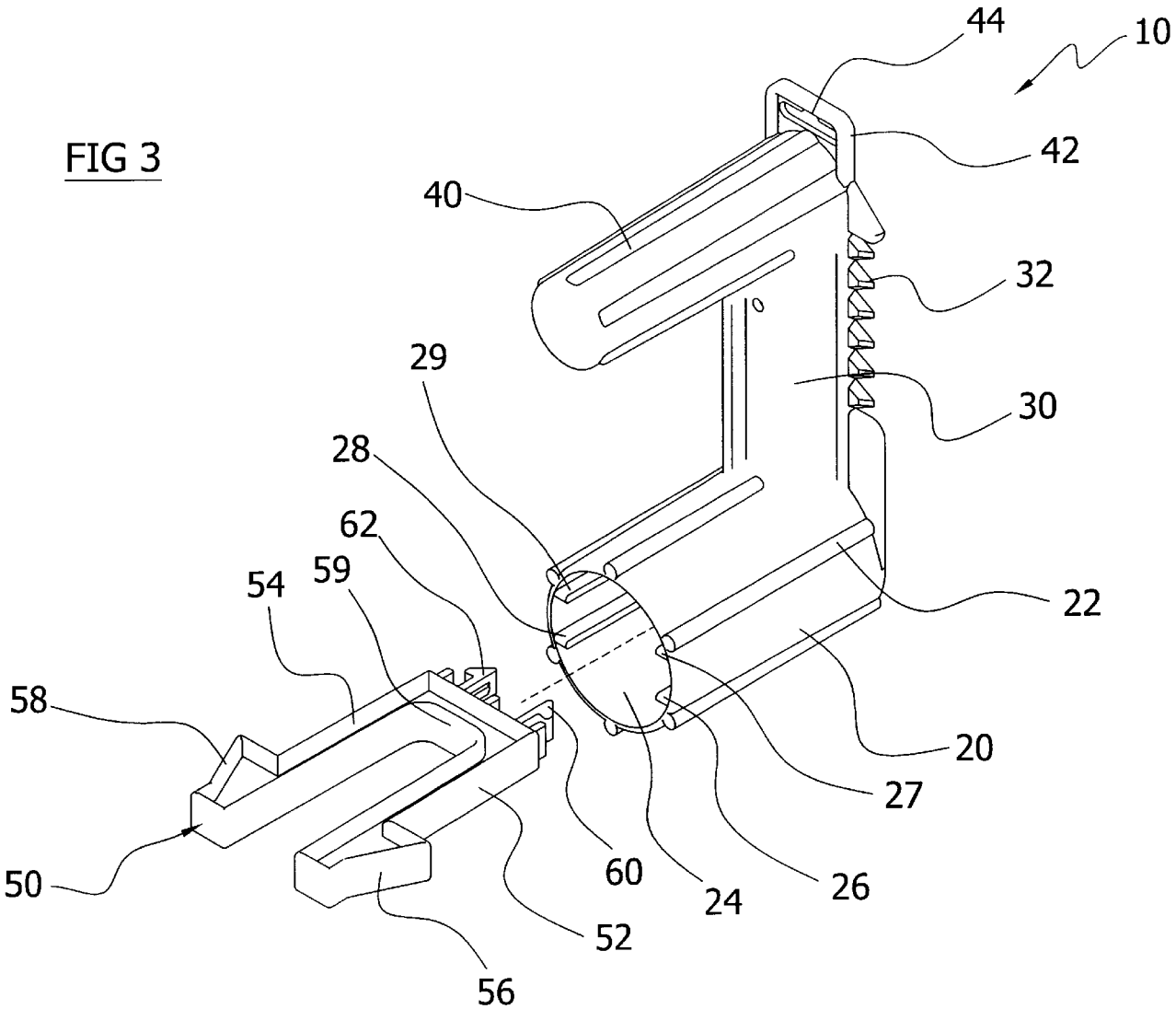
FIG. 3 is an exploded upper perspective view of the present invention.

The outer surface of the main body 20 preferably includes a plurality of rib members 22 extending longitudinally as best shown in FIGS. 2 and 3 of the drawings. The plurality of rib members 22 are designed for reducing the surface area of the main body 20 in contact with the inner surface of the spool of material 12 thereby reducing the overall resistance when the spool of material 12 is rotated upon the main body 20. It can be appreciated that various configurations of the rib members 22 may be utilized upon the main body 20.

Figure 4:
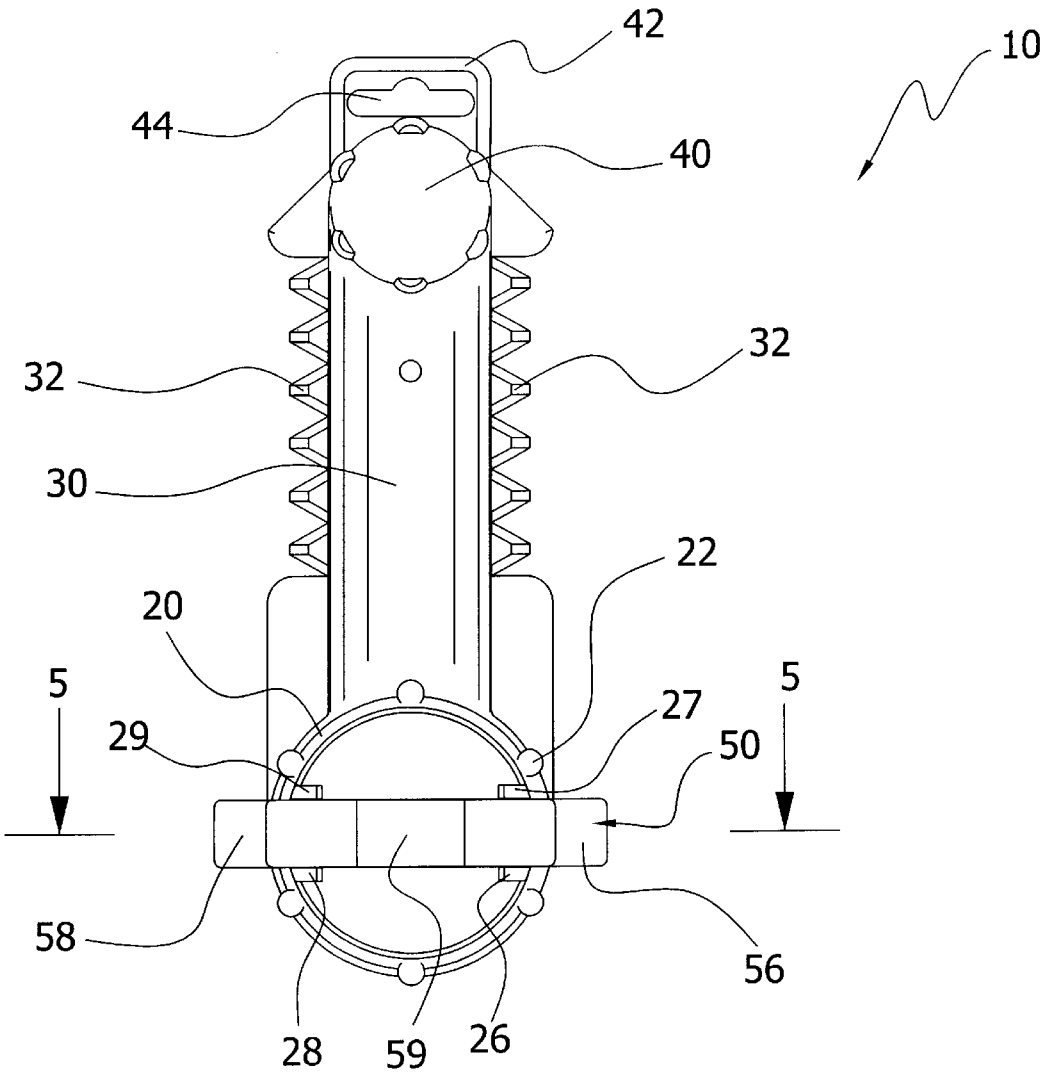
FIG. 4 is a first side view of the present invention.
Figure 7:
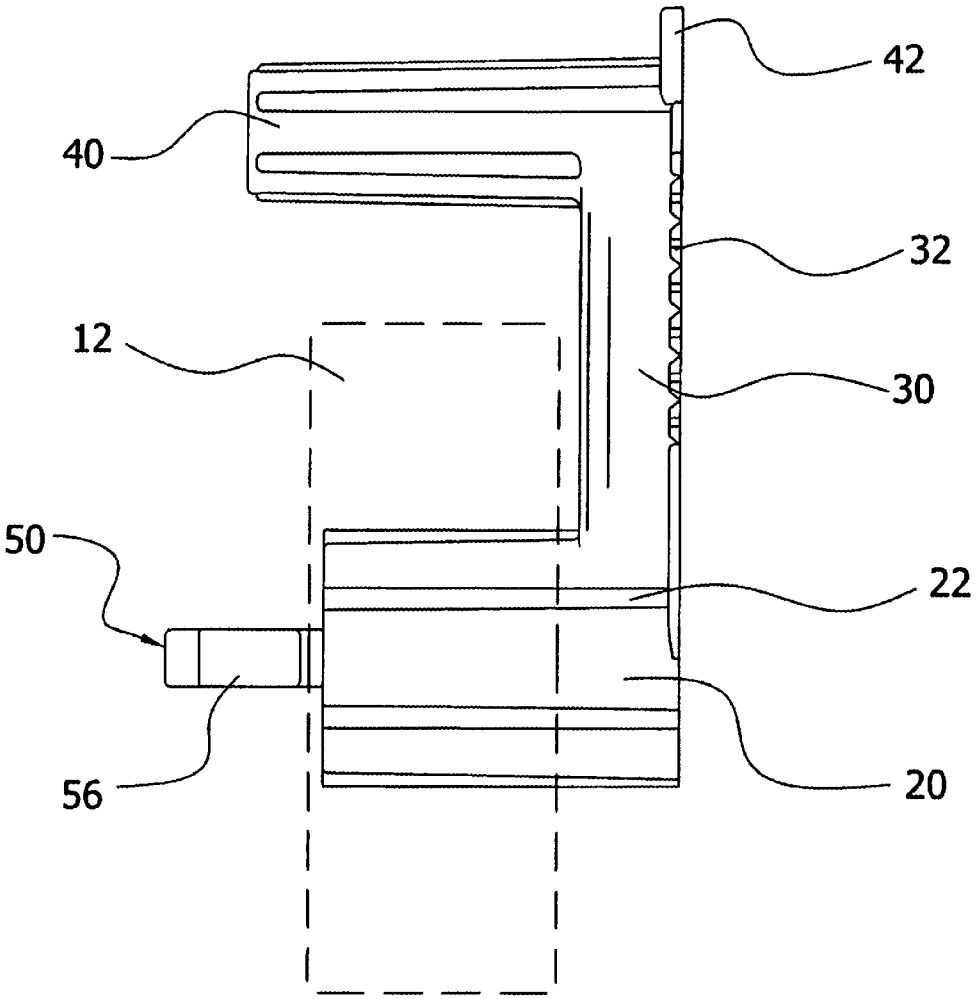
FIG. 7 is a front view of the present invention.

As shown in FIGS. 2 through 3 of the drawings, a support member 30 extends from the second end of the main body 20. The support member 30 extends substantially traversely with respect to the main body 20 as best shown in FIG. 7 of the drawings. At least one cutting edge 32 preferably extends from the support member 30 as best shown in FIG. 4 of the drawings. The cutting edge 32 may be comprised of a plurality of blades or similar cutting structure capable of cutting the material upon the spool 12.

An upper handle 40 is attached traversely to the distal end of the support member 30 as best shown in FIG. 7 of the drawings. The upper handle 40 preferably extends outwardly substantially parallel with respect to the main body 20 as further shown in FIG. 7 of the drawings. The upper handle 40 may have various ergonomic configurations for grasping by a user during loading, unloading, transporting and dispensing of a spool of material 12.

As further shown in FIGS. 1 through 4 of the drawings, a bracket 42 is attached to the upper handle 40 and the support member 30 at the intersection thereof. The bracket 42 includes an opening 44 for receiving a securing strap 14 that is utilized to attach the present invention to the belt of a user or other structure. The securing strap 14 may be comprised of a hook and loop structure for allowing easy attachment and removal of the present invention.

Figure 6:
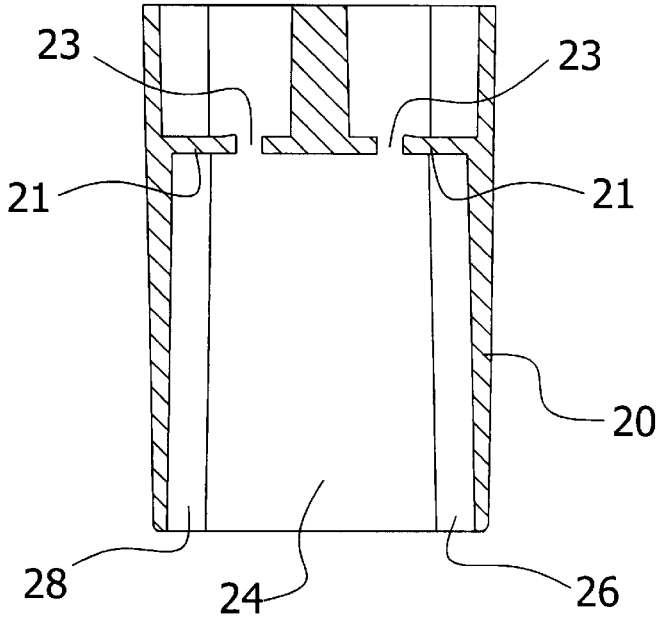
FIG. 6 is an exploded cross sectional view of FIG. 5.
Figure 6:
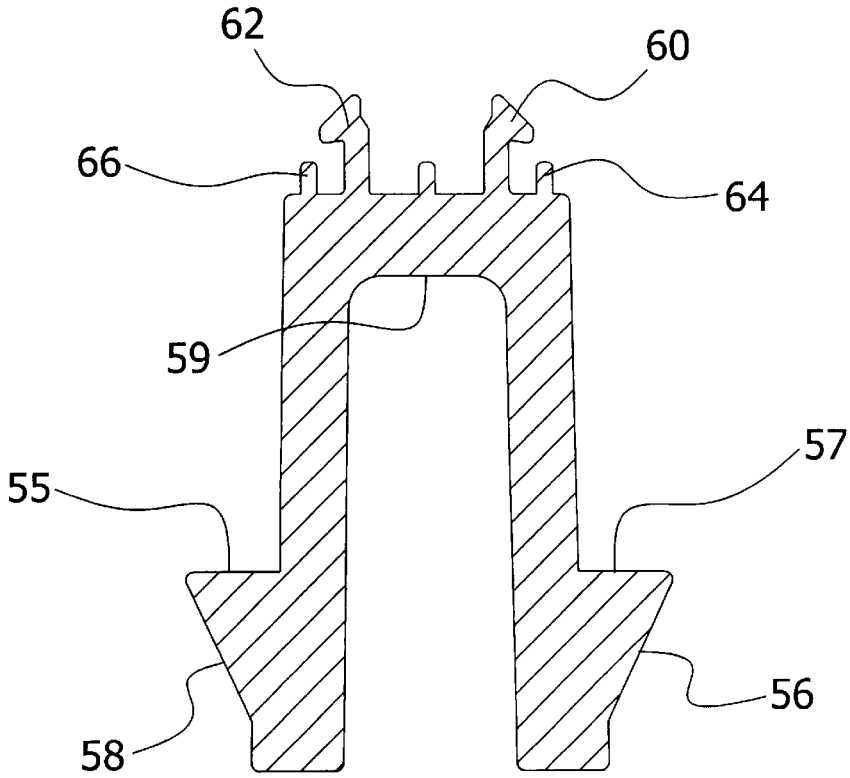
Figure 12:
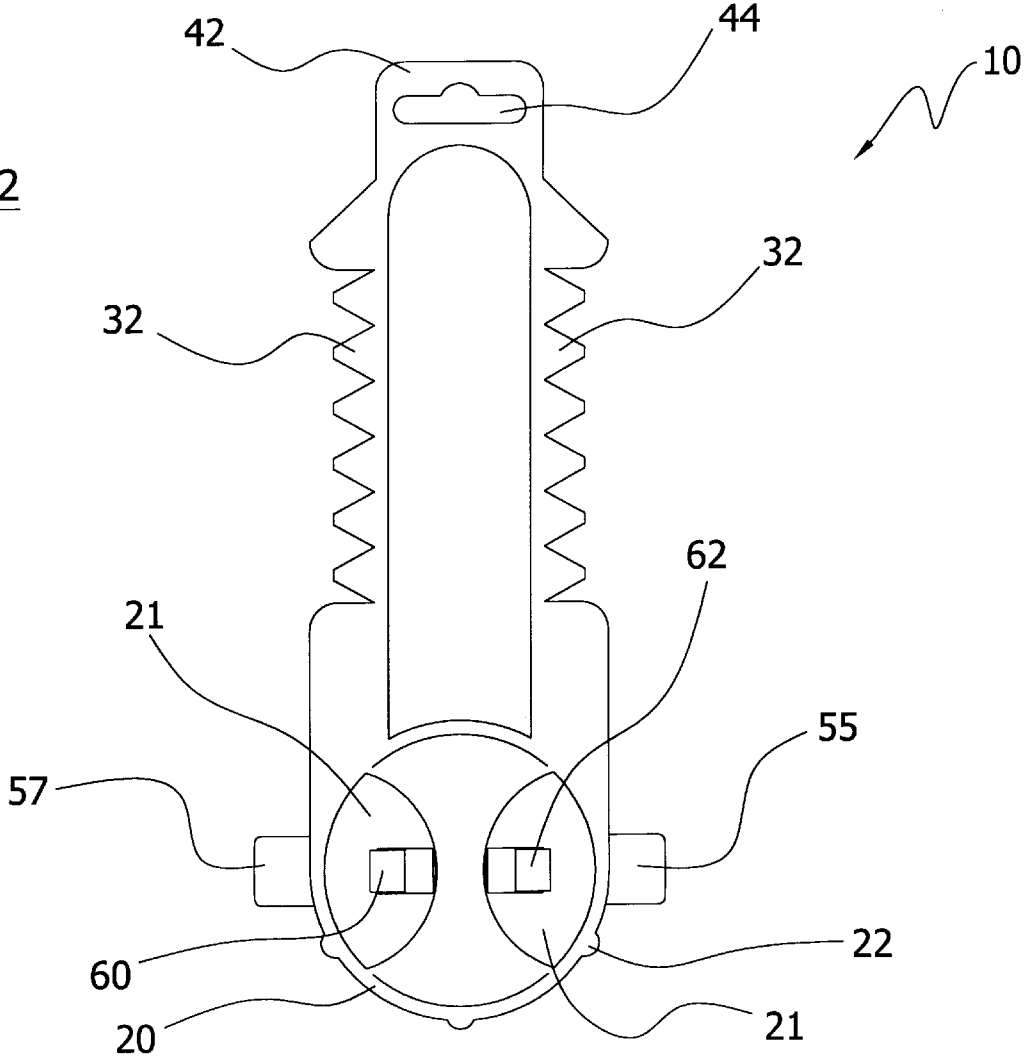
FIG. 12 is a second side view of the present invention.

As best shown in FIGS. 6 and 12 of the drawings, the main body 20 further includes a rear wall 21 adjacent to the second end thereof. The rear wall 21 preferably includes a plurality of apertures 23 for receiving the engaging members 60, 62 of the retaining prongs 50. Other attachment configurations may be utilized to secure the retaining prongs 50 within the interior portion 24 of the main body 20 as can be appreciated.

As shown in FIGS. 3 and 4 of the drawings, a first lower lip 26 and a first upper lip 27 are attached within the interior portion 24 of the main body 20. The first lower lip 26 and the first upper lip 27 define a channel for receiving a portion of the retaining prongs 50.

As further shown in FIGS. 3 and 4 of the drawings, a second lower lip 28 and a second upper lip 29 are attached within the interior portion 24 of the main body 20 preferably opposite of the first lower lip 26 and the second lower lip 28 respectively. The second lower lip 28 and the second upper lip 29 define a channel for receiving a portion of the retaining prongs 50. It can be appreciated that the channels created by the lips 26, 27, 28, 29 may also be produced by creating a channel directly within the inner surface of the interior portion 24 of the main body 20.

Figure 5:
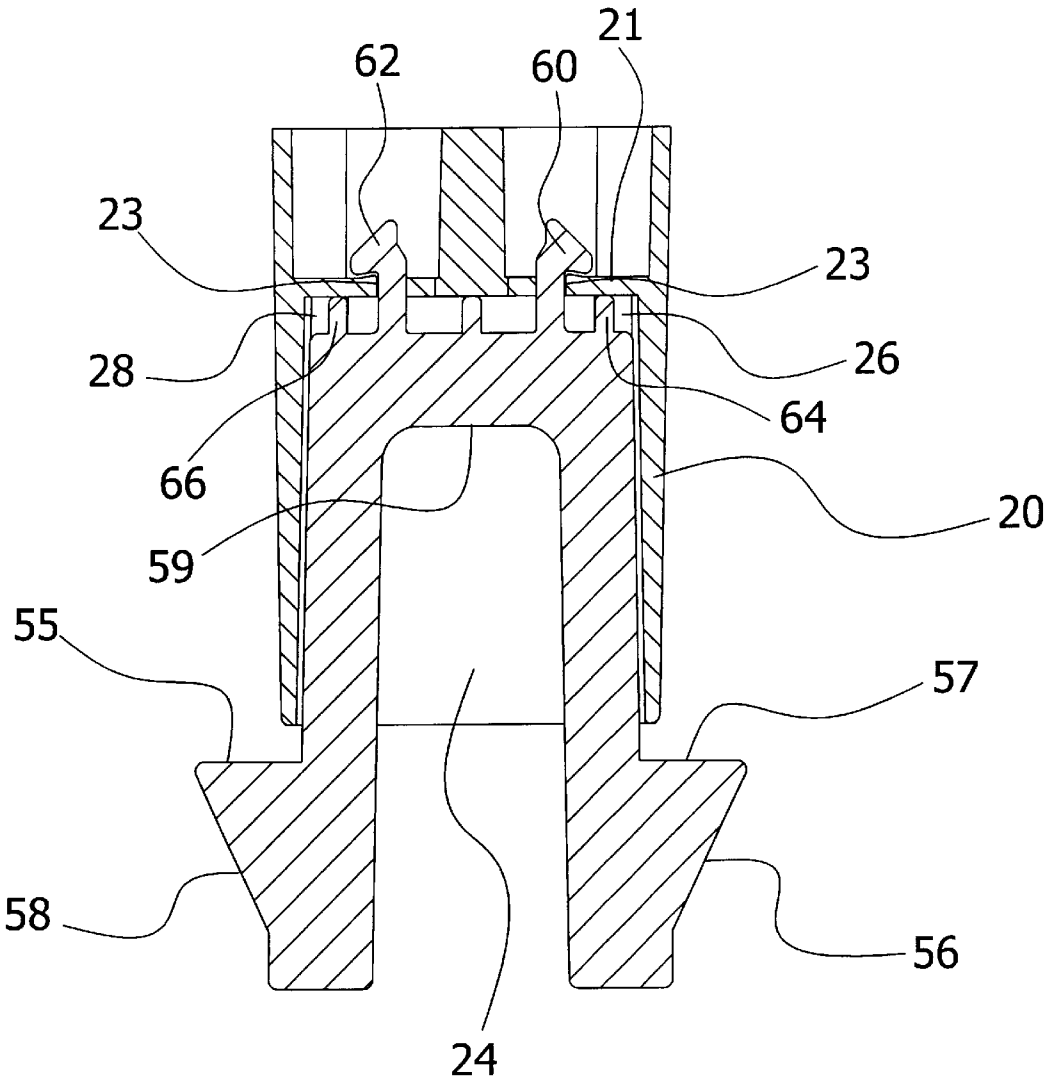
FIG. 5 is a cross sectional view taken along line 5—5 of FIG. 4.
Figure 8:
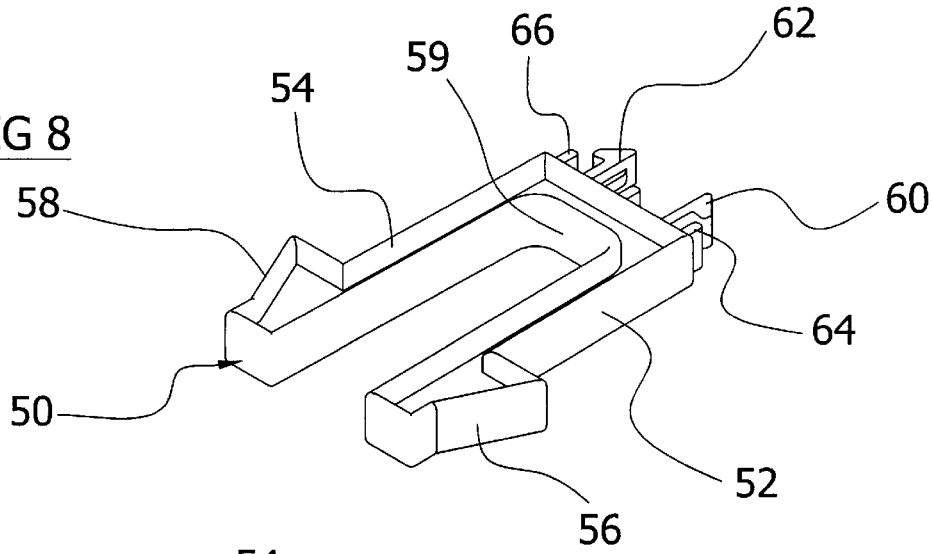
FIG. 8 is an upper perspective view of the retaining prongs.
Figure 9:
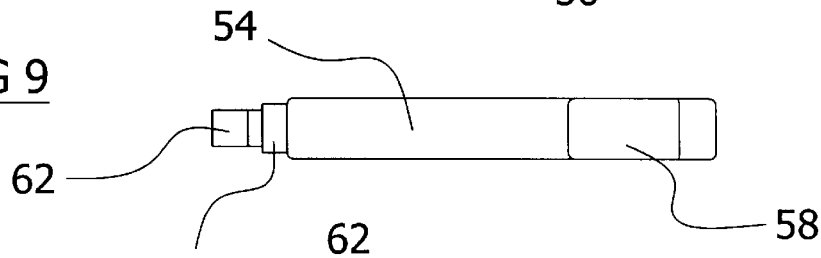
FIG. 9 is a side view of the retaining prongs.
Figure 10:
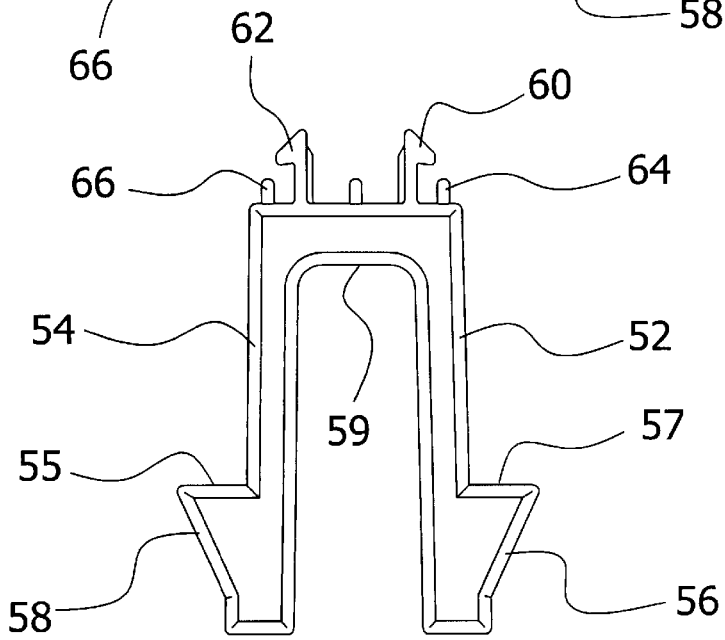
FIG. 10 is a top view of the retaining prongs.

As shown in FIGS. 3, 8 and 10 of the drawings, the retaining prongs 50 are comprised of a base 59 and a plurality of prongs 52, 54 extending from the base 59 in a resilient manner. The plurality of prongs are preferably comprised of a first prong 52 and a second prong 54, however, it can be appreciated that additional prongs may extend from the base 59. The prongs 52, 54 are sufficient in length to extend from the base 59 within the interior portion 24 of the main body 20 to outside of the main body 20 as best illustrated in FIGS. 2 and 5 of the drawings. The retaining prongs 50 are comprised of a resilient material such as but not limited to plastic or composite material.

The base 59 is attached to the rear wall 21 of the main body 20 by a first engaging member 60 and a second engaging member 62 catchably extending through corresponding apertures 23 within the rear wall 21 as best illustrated in FIG. 5 of the drawings. A plurality of spacer members 64 preferably extend from the base 59 to engage the inner portion of the rear wall 21 as shown in FIG. 5 of the drawings. However, it can be appreciated that the retaining prongs 50 may be secured within the interior portion 24 of the main body 20 utilizing well-known securing means such as adhesive, fasteners and other engaging structures. The engaging members 60, 62 are simply an exemplary securing system and should not be considered the only means for securing the retaining prongs 50 within the main body 20. To increase the flexibility of the prongs 52, 54, only the base 59 is preferably attached within the main body 20.

The distal end of each of the prongs 52, 54 have tapered flanges 56, 58 for retaining the spool of material 12 upon the main body 20 as shown in FIGS. 1 through 8 of the drawings. The flanges 56, 58 are preferably tapered to allow for easy loading of the spool of material 12.

The first prong 52 has at least a first flange 56 extending outwardly from the distal portion thereof as best shown in FIG. 10 of the drawings. The first flange 56 has a first edge 57 that is in opposition to the spool of material 12 and sometimes engages the spool of material 12 during dispensing thereof. The flanges 56, 58 are preferably a sufficient distance from the spool of material 12 to avoid constant frictional engagement with the spool of material 12 during dispensing thereof as best shown in FIG. 7 of the drawings.

The second prong 54 has at least a second flange 58 extending outwardly from the distal portion thereof as best shown in FIG. 10 of the drawings. The second flange 58 has a second edge 55 that is in opposition to the spool of material 12 and sometimes engages the spool of material 12 during dispensing thereof. The flanges 56, 58 may have various structures commonly utilized for flange structures.

The width measured from the outer portions of the flanges 56, 58 is larger than an inner diameter of the spool of material 12 thereby preventing the spool of material 12 from accidentally being removed from the main body 20 as shown in FIG. 1 of the drawings. As best shown in FIG. 10 of the drawings, the distal ends of the prongs 52, 54 are preferably similar in width to the main portion of the prongs 52, 54 to allow for easy loading of the spool of material 12.

Figure 11:
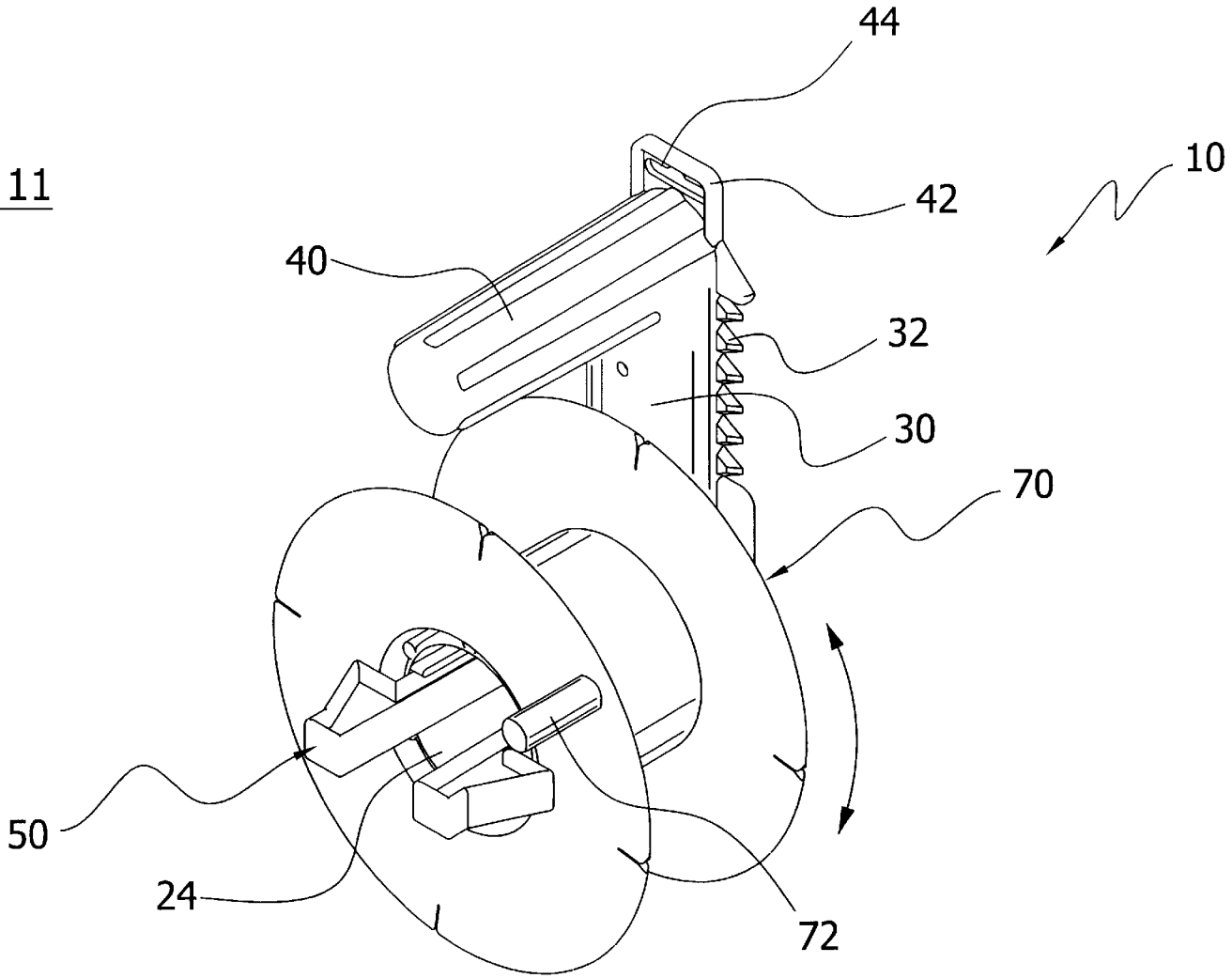
FIG. 11 is an upper perspective view of the present invention and a spool member having a side handle positioned upon thereof.

The present invention is designed to receive and dispense conventional spools 12. However, FIG. 11 illustrates an alternative spool member 70 that includes a side handle 72 for allowing dispensed elongate material to be loaded upon the spool member 70. The side handle 72 may be rotatably attached to the side of the spool member 70. The spool member 70 may be comprised of other structures not illustrated within FIG. 11 of the drawings.

In use, the user retrieves a desired spool of material 12 and then positions the spool of material 12 about the distal ends of the prongs 52, 54. The user then forces the spool of material 12 upon the prongs 52, 54 thereby causing the tapered flanges 56, 58 to engage the inner portion of the spool of material 12. The distal portions of the prongs 52, 54 are thereby forced inwardly toward one another until the inner portion of the spool of material 12 passes the extended most portion of the flanges 56, 58. The user continues to apply a force upon the spool of material 12 until fully positioned about the main body 20. After the outer edge of the spool of material 12 passes over the first edge 57 and the second edge 55 of the flanges 56, 58, the prongs 52, 54 are free to expand outwardly to their original position thereby securing the spool of material 12 upon the main body 20. The user is then free to dispense or load the elongate material as desired by the rotation of the spool of material 12 about the main body 20. The user may sever the elongate material by using the cutting edge 32 within the support member 30. When the user desires to replace the existing spool of material 12, the user grasps the distal portions of the prongs 52, 54 and applies an inward force upon thereof thereby contracting the prongs 52, 54. When the flanges 56, 58 are able to be passed about by the spool 12, the user then simultaneously forces the spool of material 12 outwardly over the prongs 52, 54 until completely removed. The user then repeats the above process to position the new spool of material 12 upon the main body 20.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed to be within the expertise of those skilled in the art, and all equivalent structural variations and relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A material dispensing system, comprising:

a main body having an open end and an interior portion, wherein said main body is formed for rotatably receiving a spool of material;

a handle structure attached to said main body;

a base secured within said interior portion;

a plurality of resilient prongs extending from said base and a distal portion of said prongs extending outwardly from said open end within said spool of material and extending past said spool of material; and a flange extending from each of said prongs for retaining said spool of material upon said main body.

2. The material dispensing system of claim 1, wherein said plurality of prongs are substantially parallel to one another.

3. The material dispensing system of claim 1, wherein said flange is comprised of a tapered structure narrowing toward a distal end of said prongs.

4. The material dispensing system of claim 3, wherein said flange includes a retaining edge that is in opposition to said spool of material.

5. The material dispensing system of claim 4, wherein said retaining edge is substantially traverse to a radial axis of said spool of material.

6. The material dispensing system of claim 1, wherein said plurality of prongs is comprised of a first prong and a second prong in opposition to one another.

7. The material dispensing system of claim 6, including a first channel and a second channel within said interior portion of said main body for receiving said first prong and said second prong respectively.

8. The material dispensing system of claim 7, wherein said first channel and said second channel are each comprised of an upper lip and a lower lip spaced apart and extending within said interior portion of said main body.

9. The material dispensing system of claim 1, wherein said main body includes a rear wall having a plurality of apertures opposite of said open end, and wherein said base includes a plurality of engaging members extending opposite of said prongs for catchably extending within said plurality of apertures.

10. The material dispensing system of claim 9, including a plurality of spacer members extending from said base opposite of said prongs.

11. The material dispensing system of claim 9, wherein said engaging members are comprised of a hook structure.

12. The material dispensing system of claim 1, including a spool member having a side handle positionable about said main body.

13. A material dispensing system, comprising:

a main body having an open end and an interior portion, wherein said main body is formed for rotatably receiving a spool of material;

a handle structure attached to said main body, wherein said handle structure includes a support member extending from an end of said main body opposite of said open end and an upper handle attached to a distal end of said support member;

at least one cutting edge secured within said support member for cutting an elongate material from said spool of material;

a base secured within said interior portion;

a plurality of resilient prongs extending from said base and a distal portion of said prongs extending outwardly from said open end; and a flange extending from each of said prongs for retaining said spool of material upon said main body.

14. The material dispensing system of claim 13, including a bracket having an opening attached to said upper handle for receiving a securing strap.

15. The material dispensing system of claim 13, wherein said upper handle extends from said support member in a direction of said open end of said main body.

16. The material dispensing system of claim 15, wherein said upper handle is substantially parallel to said main body.

17. A material dispensing system, comprising:

a main body having an open end, a plurality of rib members extending parallel to a longitudinal axis of said main body and an interior portion, wherein said main body is formed for rotatably receiving a spool of material;

a handle structure attached to said main body;

a base secured within said interior portion;

a plurality of resilient prongs extending from said base and a distal portion of said prongs extending outwardly from said open end; and a flange extending from each of said prongs for retaining said spool of material upon said main body.

* * * * *